US007942457B1

(12) United States Patent
Bell

(10) Patent No.: US 7,942,457 B1
(45) Date of Patent: May 17, 2011

(54) LEVER-HANDLED POCKET DOOR LATCHING SYSTEM

(76) Inventor: Donald Bell, Orange, CA (US)

( * ) Notice: Subject to any disclaimer, the term of this patent is extended or adjusted under 35 U.S.C. 154(b) by 539 days.

(21) Appl. No.: 12/074,458

(22) Filed: Mar. 3, 2008

Related U.S. Application Data

(60) Provisional application No. 60/921,344, filed on Apr. 2, 2007.

(51) Int. Cl.
*E05C 9/00* (2006.01)
*E05C 5/02* (2006.01)

(52) U.S. Cl. ..... 292/6; 292/71; 292/219

(58) Field of Classification Search ..... 292/137, 292/1.5, 6, 70, 71, 163, 219; 70/77, 91, 95, 70/99, 100
See application file for complete search history.

(56) References Cited

U.S. PATENT DOCUMENTS

| | | | | | |
|---|---|---|---|---|---|
| 573,934 | A * | 12/1896 | Trepte | 70/131 |
| 1,168,524 | A * | 1/1916 | Lurie | 70/142 |
| 2,233,828 | A * | 3/1941 | Anderson | 70/145 |
| 2,275,089 | A * | 3/1942 | Pirtz | 70/99 |
| 2,540,686 | A * | 2/1951 | Milburn | 292/124 |
| 2,581,606 | A * | 1/1952 | Seaman et al. | 292/74 |
| 2,668,073 | A * | 2/1954 | Collar et al. | 292/192 |
| 2,749,164 | A * | 6/1956 | Kitzelman | 292/121 |
| 2,770,124 | A * | 11/1956 | Welch | 70/474 |
| 3,175,376 | A * | 3/1965 | Cantwell | 70/131 |
| 3,206,954 | A * | 9/1965 | Snyman | 70/150 |
| 3,360,290 | A * | 12/1967 | De Gray | 292/6 |
| 3,582,119 | A * | 6/1971 | Woodworth | 292/27 |
| 4,312,527 | A * | 1/1982 | Tannery | 292/49 |
| 4,566,725 | A * | 1/1986 | Klein | 292/191 |
| 4,765,663 | A * | 8/1988 | Raymond et al. | 292/169.13 |
| 5,369,969 | A * | 12/1994 | Sassella et al. | 70/90 |
| 5,452,928 | A * | 9/1995 | Donald | 292/254 |
| 5,529,351 | A * | 6/1996 | Donald | 292/254 |
| 5,540,066 | A * | 7/1996 | Takimoto | 70/99 |
| 6,174,003 | B1 * | 1/2001 | Smart | 292/109 |
| 6,938,375 | B2 * | 9/2005 | Duncan et al. | 49/372 |
| 7,036,851 | B2 * | 5/2006 | Romig | 292/24 |

* cited by examiner

*Primary Examiner* — Carlos Lugo
*Assistant Examiner* — Alyson M Merlino

(57) ABSTRACT

With the adoption of this new modern latching system, (FIG. 1) closing and latching a pocket door will be just as simple and convenient as closing and latching a swinging door, irregardless of the physical capability of the operator. This system has been masterfully designed and engineered with appropriate lever handles 20 that are prominently mounted on the face of the door, where they will be convenient to use by people of all ages and physical encumbrances. Coupling these handles to a reliable automatic latching embodiment 15 and complementing the completed assembly with door guides 22, promises to be a bold step forward in latching concepts for modern interior pocket doors.

1 Claim, 2 Drawing Sheets

Figure 2:
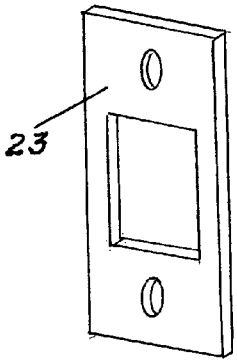

27
31
30
15
25
18
39
40
32
36
41
34
33
17
18
26
37
18
35
19
28
29

LEVER-HANDLED POCKET DOOR LATCHING SYSTEM

CROSS REFERENCE TO RELATED APPLICATION

This application claims the benefit of PPA Ser. No. 60/921,344 filed Apr. 2, 2007 by the present inventor, which is incorporated by reference.

FEDERALLY SPONSORED RESEARCH

NONE

SEQUENCE LISTING

NONE

BACKGROUND OF THE INVENTION

This invention relates to hardware for latching interior doors, more specifically to a novel and unique embodiment for latching interior pocket doors, though not necessarily limited to that end.

BACKGROUND OF PRIOR ART

In the building trade, an interior door that has been designed to glide in and out of a wall cavity using an overhead track and roller system, with the purpose of closing off an entrance to a room, is known as a pocket door. This type of door was commonly used in years past when homes were smaller and it was convenient to have a room entry door that retreated into an accommodating wall in order to allow space for furniture. However, installations of this type of door have been markedly declining, principally because the existing hardware for these doors is not adequate for handicap usage, and seemingly, the technology for interior pocket door hardware has not advanced beyond the present stage of forger-operated devices, which are outdated and woefully inadequate for modern home usage. Nevertheless, these items are continuing to be installed on interior pocket doors in homes because there is nothing else available.

These referenced hardware items consist of a finger-hooking device that is recessed into the leading edge of the door and shallow metal finger-pocket, or flush-pulls, that are recessed into the face of the door. To close a pocket door with these devices, requires an operator to first retrieve the concealed edge-mounted finger-hook, into which a finger is inserted and the door is thereby pulled out of the wall cavity until a finger-pocket on the face of the door is exposed. Thereupon, the finger would be moved into that pocket and the movement of the door continued to closure.

This is not a challenging operation for anyone with a modicum of dexterity and reasonably strong fingers, however, for an elderly person with arthritic fingers, or a disabled person who depends upon a 'walker' or wheel-chair for mobility, the normally simple task of closing a pocket door can be an arduous undertaking that invariably necessitates the assistance of another. Moreover, should a handicapped person manage to close the door, but wanted to latch it for privacy, he is obliged to use yet another 'door-mounted-finger-oriented rotating device' that is located within the face-mounted pocket. This device must be squeezed tightly between the forefinger and thumb of one hand, and rotated until a moveable latching element reaches out from the edge of the door and settles into a fixed keeper on the door frame. Throughout this latching procedure, the door must be held closed against the door frame with the finger tips of the other hand.

Some years back, a lock manufacturer sought to improve on this awkward door closing and latching situation by consolidating the three separate elements, that is the edge-pull, the flush-pull, and the moveable latching element, into one embodiment, which was then marketed as a pocket door latch. However, this consolidation came at the high price of further aggravation to homeowners because the utilization of each of these elements was severely compromised.

The metal finger-pockets that had been recessed in the face of the door were replaced by mere indentations on each side of the latching embodiment's housing, and the former 'two-finger' edge-hook now only allows for one finger usage. In addition, the little rotating device for activating the latching element was made even more diminutive and more difficult to operate.

Unlike the modifications that were made in the latching hardware for swinging doors, wherein the familiar round operating knobs were replaced with suitably-sized lever handles for the convenience of handicap users, these finger-pull elements have never been so modified.

While there are numerous custom designed latching systems for heavier exterior sliding doors, these systems cannot be successfully adapted for use in lighter interior pocket doors, nor do the methods of locking these doors, or their typically large handle configurations meet the requirements of interior pocket door operation. Also, their design and styling is incompatible with existing interior door hardware.

SUMMARY

These antiquated finger-pull elements are extremely deficient for closing and latching pocket doors, therefore a new and different latching system is essential to facilitate the handicapped in the operation of such doors, and make these operations as simple and easy as those of swinging doors. Pursuant to that, any new latching hardware for pocket doors should be contemporaneous with existing swinging door hardware, particularly in the utilization of suitably-sized lever handles for both moving the door and operating the latching system. Moreover, such handles should be conveniently located on the face of the door, where they would be visible and readily accessible. It is equally important that the new system include a mechanism that will latch the door automatically on closure, without requiring assistance from the operator.

The proposed latching system herein described, exceeds all of these requirements through a unique assemblage of innovative ideas that elevates its performance over the best of the swinging door latching systems in its inherent simplicity, ease of operation, and dependability.

At the forefront of these new ideas is the implementation of suitably-sized lever type handles, whereby an operator can grasp and move the door quickly and easily instead of painstakingly searching for a punitive one-finger pull. Moreover, with these conveniently accessible lever handles, the operator can position himself within the room and single-handily close the door from start to finish in one smooth operation. Notwithstanding, the door can also be closed and latched by simply pushing on the handle with a hand or another part of the body.

This pushing action for closing the door is made possible through a unique and innovative self-latching mechanism in the embodiment, which latches the door to the door frame automatically, and retains the door in that closed position until the operator rotates the handle slightly, which thereby releases the latch. This automatic latching feature makes this system a truly modern latching system.

This embodiment also features a novel means of locking the latching mechanism from being inadvertently released. Moreover, this locking action can be pre-set by the door installer to function either automatically or manually by the operator. Thus, when a person desires secured privacy in a room, the locking feature can be pre-set to either lock the closed door automatically, or require the operator to manually lock the door. Automatic locking would be the preferred way for handicapped users. The 'locked handles', also indicate to those outside of the room that the occupant desires privacy.

ALTERNATIVE EMBODIMENTS

There are some home installations, such as clothes closets, laundry, and utility rooms, where this looking feature would not be required. In these installations, the embodiment can be configured to effectively de-activate the locking mechanism. Should the locking feature be desired later, the operating shaft is turned 'end-for-end' in the embodiment, and the locking feature is restored.

There might also be installations when a "keyed lock" is desirable on a pocket door. As presently determined, this same latching embodiment can be used with a modified shaft support, into which a keyed cylinder can be installed. The shaft support would accommodate this keyed cylinder as well as a moveable locking element within, which has been designed to engage a slot in the hub of a handle when the key in the cylinder is turned 90 degrees. When this locking element is engaged in the slot, the handle is prevented from moving laterally and therefore cannot be rotated to unlatch the door.

Consistent with this new latching system are two metal door guides that are fastened on the two vertical wood members that frame the wall cavity. These guides are positioned adjacent to each other, with one on either side of the door opening, and centrally located about the shaft supports. Of their several purposes, the primary one is to control the side to side motion of the door when it is being moved across the entry space and thereby guide the nosepiece of the embodiment into the keeper plate on the opposite door frame.

ADVANTAGES

This embodiment has been designed to enable a handicapped or disabled person to solitarily operate an entrance pocket door for privacy in a room. In that aspect, the use of 'grip-sized' handles have a definite advantage over minuscule finger hooks and finger-pulls. These handles provide something solid for a handicapped person to grab onto, and that alone can give him the impetus to tackle the door closure alone. Of greater benefit, will be the operator's satisfaction in obtaining privacy that heretofore has been denied to handicapped users, and the gratitude of having a pocket door that latches closed automatically.

LIST OF DRAWINGS

Figure 3:
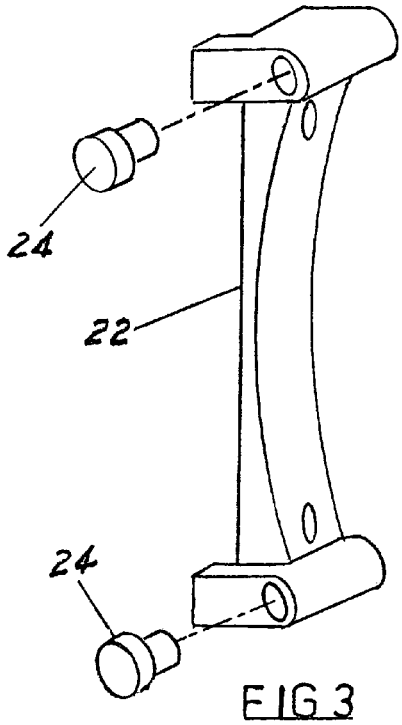
Figure 1:
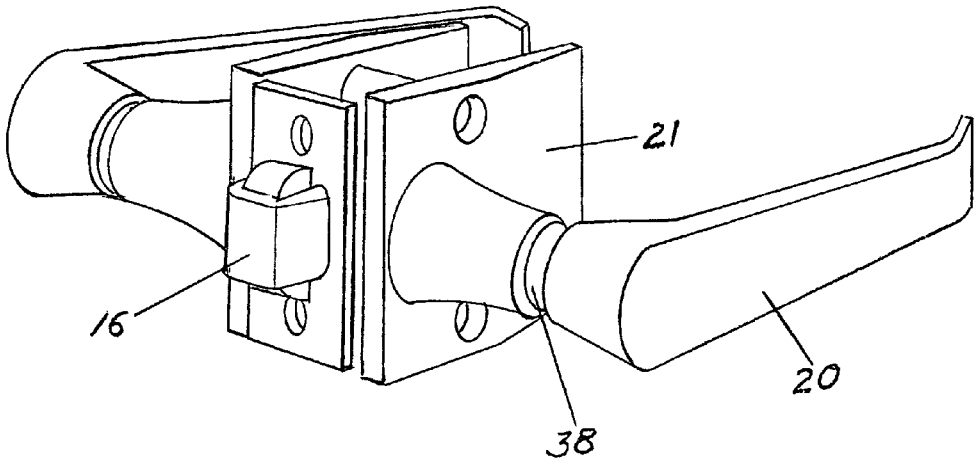
Figures 4, 5, 6, 7, 8, 9:
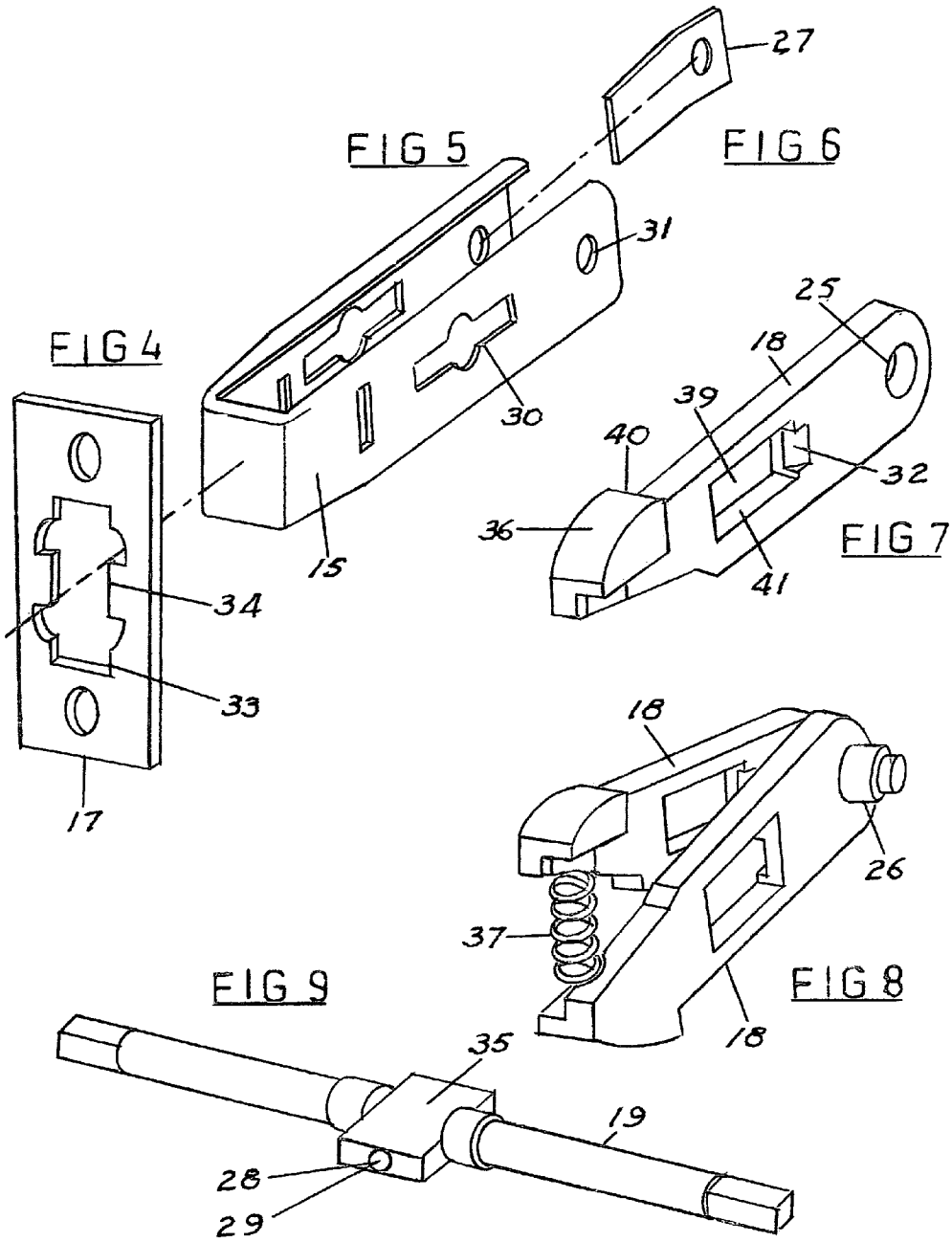

FIG. 1 Latching embodiment
FIG. 2 Keeper plate
FIG. 3 Door guide
FIG. 4 Embodiment mounting plate
FIG. 5 Platform
FIG. 6 Flat spring
FIG. 7 Latching element
FIG. 8 Latching element assembly
FIG. 9 Operating shaft

LIST OF REFERENCE CHARACTERS

15 Platform
16 Latching embodiment
17 Mounting plate
18 Latching element
19 Operating shaft
20 Handle-two required
21 Handle support-two required
22 Door guide—two required
23 Latch keeper plate
24 Cushioning element
25 Sized hole
26 Tubular shaft
27 Flat spring
28 Steel ball
29 Compression spring
30 Slot in platform
31 Sized hole
32 Chamfer
33 Mounting plate hole
34 Material projections
35 Flattened shaft section
36 Latching head
37 Latching spring
38 Plastic sleeve inserts
39 Rectangular hole
40 latching surface
41 Cam surface

DETAILED DESCRIPTIONS

FIG. 1—Preferred Embodiment

FIG. 1 shows a perspective view of my pocket door latching embodiment, together with a metal latch keeper plate 23, (FIG. 2) that would be affixed to the opposite door frame, and two metal door guide elements 22, (FIG. 3) that would be installed on the framing members on both sides of the wall cavity. The purpose for these guides is to constrain the door to a narrow path across the entryway and thereby guide the nosepiece of the embodiment into the keeper plate. To accommodate that guidance, the metal guides are equipped with small cushioning elements 24, that would impinge on the door throughout its travel, rather than the bare metal of the guide itself, and thereby alleviate scuffing the finished surface of the door.

The lever handles 20 are of selected design and shape for handicap usage. The two handle supports 21 are mounted securely to each other and firmly held on the face of the door, providing adequate wide support for the handles. Plastic sleeve inserts 38 will serve as minimal friction bearing elements between the axis column of each handle and its handle support.

The latching embodiment 16, is an assemblage of elements that are structured on or around a metal element that I refer to as a platform 15, (FIG. 5) My preferred material for this platform is sheet steel, because it can be cut and formed into a strong "U" shaped mounting element that on assembly will adequately support the two latching elements 18 as well as an operating shaft 19.

The unique slots 30, in each of the two legs of the platform 15, are shown as being punched through, however they may be pierced and extruded to the same inside dimensions for improved rigidity of the platform. These slots have been designed to match the unusual configuration of the operating shaft 19, with marginal clearance. The circular portion in the center of the slot is intended to position the operating shaft 19 in the correct operating position within the rectangular opening 39 of the two latching members 18 on assembly, whereas the narrow portions on each side of the circular hole will provide the fixed aperture for the embodiments shaft locking feature.

On the open end of the platform 15, both legs have a sized hole 31 into which a tubular shaft 26 is inserted on assembly. Both ends of this shaft are swaged to affix it in place. When thusly assembled, this tubular shaft will serve as the hinge pin for the two latching members 18 (FIG. 8)

The closed end of the platform 15, tapers slightly narrower in width to allow for an easier entrance of this closed end of the platform into the hole in latch keeper plate 23.

The mounting plate 17, (FIG. 4) for this embodiment has a custom-shaped hole 33 through its flat surface, whose perimeter outline matches the formed shape of the platform 15, except for the small inward projection 34 of material on each side of the hole. These two projections of metal should fit snugly into two mating slots in the sides of the platform when the two elements are thereby assembled.

A flat metal spring 27 (FIG. 6) is used to apply the needed pressure to move the operating shaft 19 laterally a sufficient amount to engage the flattened section of the shaft 35 in the slot 30 in the platform 15. This engagement between the operating shaft and the platform constitutes the embodiment's locking feature.

The operating shaft 19, (FIG. 9) should be made of a strong material, such as steel. The shaft's flattened section 35, has been designed to function as a cam actuator for the paired latching members 18, (FIG. 8), The completed shaft will also have a drilled hole centrally located on one edge of the flattened portion of the shaft. A small compression spring 29 (not shown) is inserted into this hole, followed by a small steel ball 28 that will provide a 'ball latching' system to prevent lateral movement of the operating shaft.

The latching member 18, (FIG. 8) is a uniquely designed element wherein one of its ends has an arrow-head shaped projection 36 with its rising outer edge slightly rounded and an abrupt drop-off 40, which will provide a suitable surface for latching onto a metal keeper plate 23 that is affixed to the door frame. Located on the underside of that rounded outer surface of the latching head 36 is a shallow flat-bottomed hole that will nest one end of a small compression spring 37.

On the opposite end of the latching member 18, there is a close tolerance through-hole 25 that will slip over the tubular shaft 26 on assembly. Midway in the length of the latching member, there is a rectangular-shaped through-hole 39, through which the operating shaft 19 will be inserted on assembly. The design of this rectangular hole is critical in the operation of the latching mechanism, in that one of its perimeter surfaces 41 will be used as a cam follower for moving the latching member, while the opposite perimeter surface will serve to limit the shaft's rotation to approx. 25 degrees. On one end of that rectangular hole, but only on one side of said latching member as shown, there is a purposeful 45 degree chamfer 32 that will serve as a detent for the spring-pressured steel ball 28 located on the shaft 19. As shown in FIG. 8, two of these latching members 18 are inverted to each other, and linked together in hinge-like fashion with the tubular shaft 26 acting as the hinge pin. A compression spring 37 that nests between the two latching heads 36, provides the energizing force for the automatic latching mechanism of the embodiment.

Operation of Latching Embodiment

This embodiment was designed to emulate the function of a swinging door latching system wherein similarly large lever handles are utilized for opening, closing, and unlatching the door. An automatic latching mechanism therein holds the door closed whenever it is brought to that position. Assured privacy for the room's occupant is attained through a novel locking feature of this latching mechanism. Not withstanding, should an emergency arise, this locking feature can be easily overridden by simply moving the handle laterally before turning it to open.

The prominent feature of this embodiment is the exposed lever handles 20. These conveniently accessible handles are infinitely more practical for operating the door than the miniature recessed finger hooks, finger pockets, and twisting devices that have heretofore been the only available means for operating interior pocket doors. Additionally, lever handles have been previously approved for handicapped operation of swinging doors, therefore, it is expected that their usage on interior pocket doors would also be acceptable.

Henceforth, the successful operation of pocket doors need not depend upon the operator's deftness in holding the door in alignment while closing it, nor on the capability of the operator in holding the door closed while rotating a little gadget to latch the door to the frame, for the frame-mounted door guides 22 that have been described herein will correctly guide the door's movement to the fixed keeper plate on the opposite frame, and the incorporated mechanism will latch the door automatically.

This latching process is accomplished by a novel mechanism that is comprised of two identical latching members 18 that are assembled adjacent to each other, (FIG. 8) with a tubular shaft 26 serving as a type of hinge pin linking these two members. When these paired members and the flat spring 27 are thusly assembled in the open end of the platform, both ends of the shaft 26 will ostensibly be headed over.

The small compression spring 37 that is nested between the latching heads on the free ends of the latching members, is intended to spread the free ends of these two latching members apart to the perimeter limit of the hole in the embodiment's mounting plate 17.

Automatic latching of the door will occur when the door has been closed to the frame, and the nose-end of the latching platform has simultaneously entered the hole in the fixed keeper plate 23.

As the nose of the latching platform progresses into the keeper plate hole, the limiting diameter of that hole forces the two latching members therein to retract further within the confines of the platform, while simultaneously compressing the spring 37 that nests between the heads of the two latching members.

When the heads of these latching members have fully passed through the hole in the keeper plate, this compressed spring 37 immediately reacts outwardly and spreads the latching members apart, thereby causing the heads to hook behind the keeper plate and effectively latch the door.

While this latching process is achieved automatically by the sudden expansion of this compressed spring, the un-latching process requires an operator to manually rotate the lever handles some twenty-five degrees in either direction. This rotation causes the latching member heads to again retract within the platform, thereby releasing the respective heads from the keeper plate and unlatching the door.

Uniquely in this mechanism, the two latching members 18 have been inverted on assembly, which causes these members to react inwardly when the handles are manually rotated. Because of this inverted condition, the cam action of the flattened portion of the shaft 19 against the inner surface 41, on each of the rectangular holes in the latching members, causes the free end of these members to draw together rather than spread apart. It is this inward drawing of the members that withdraws the respective latching heads from the keeper plate and allows the door to be opened.

The privacy latch-locking feature of this embodiment becomes effective when the operating shaft 19 is caused to move laterally through the embodiment, rather than being rotated. When the shaft is thus moved laterally, either by the force of the flat spring 27, or manually by the operator, a portion of the flattened section 35 of the shaft 19 is caused to enter into an accommodating slot 30 in the wall of the platform 15. This engagement prevents the shaft, and subsequently the operating handles, from being rotated with the resultant un-latching of the door.

As heretofore mentioned, the operating shall 19 has a small steel ball 28 with its accompanying compression spring 29 installed on one edge of the flatted portion 35 of the shaft. Attendant with that ball and spring is a 'V' shaped detent that is formed between the two latching members, when the 45 degree chamfers on the same edge of the rectangular hole in each latching member are brought together on assembly. This arrangement effectively makes a 'ball and detent' latch which restrains any lateral movement of the shaft, and thereby deactivates the privacy locking feature.

When the shaft 19 is installed in the embodiment with the steel ball facing away from the leading edge of the door, privacy locking and unlocking will be achieved by manually moving the handle laterally and overcoming the ball and detent restraint. However, when the shaft is installed in the embodiment with the steel ball facing the leading edge of the door, the ball and detent feature becomes ineffective, and locking will be achieved automatically through lateral movement of the shaft by the pressure of the flat spring 27.

I claim:

1. A door latch assembly comprising:

a door moved between a latched and an unlatched state;

a keeper plate mounted to a door frame of the door, the keeper plate defining a keeper opening;

a latching mechanism including:

a sliding latching platform for movement within the door between a latched position, in which the latching platform is received through the keeper opening, and an unlatched position, the sliding platform having a nose and a pair of sidewalls, extending from the nose, each sidewall including a slot and a sized hole at an opposite end;

a pair of latching elements pivotally mounted to the sized hole of the latching platform, each latching element comprising a slot and a latching head, each located at an end opposed to the pivotal end and facing away from each other;

a spring member located between the latching heads;

an operating shaft received through the slots of the latching platform, the shaft having an operating flat middle section that is positioned within the openings of the latching elements;

a flat spring member operatively connected to the operating shaft middle section;

operating means connected to each end of the operating shaft to move the operating shaft between an operating and a non-operating state;

wherein, when the door is positioned within the door frame, the latching platform is received through the keeper opening, and the latching heads will retract within the latching platform;

when the latching heads have fully passed through the keeper opening, the spring member will bias each latching head away from the latching platform, causing the heads to hook behind the keeper plate and effectively positioning the door in the latched state;

wherein, in order to position the door in the unlatched state, operation of the operating means will rotate the operating shaft, so that the middle section will engage the openings of the latching elements, to move the latching heads within the latching platform, allowing retraction of the latching platform from the keeper plate.

* * * * *